United States Patent [19]

van Laarhoven

[11] 4,309,166

[45] Jan. 5, 1982

[54] COMBUSTION FLASHBULB

[75] Inventor: Aloysius M. M. van Laarhoven, Tilburg, Netherlands

[73] Assignee: U.S. Philips Corporation, New York, N.Y.

[21] Appl. No.: 967,939

[22] Filed: Dec. 11, 1978

[30] Foreign Application Priority Data

Dec. 23, 1977 [NL] Netherlands ..... 7714304
Jun. 19, 1978 [NL] Netherlands ..... 7806572

[51] Int. Cl.[3] ..... F21K 5/02; H05B 43/02
[52] U.S. Cl. ..... 431/358; 362/13
[58] Field of Search ..... 431/358, 359, 362; 362/13–15

[56] References Cited

U.S. PATENT DOCUMENTS

| | | | |
|---|---|---|---|
| 2,768,517 | 10/1956 | Atkinson et al. | 431/362 |
| 2,868,003 | 1/1959 | Albrecht | 431/362 |
| 3,045,460 | 7/1962 | Brouse et al. | 431/362 |
| 3,312,085 | 4/1967 | Schilling et al. | 431/362 |
| 3,500,732 | 3/1970 | Nijland et al. | 431/359 |
| 3,532,931 | 10/1970 | Coté et al. | 431/359 |
| 3,694,696 | 9/1972 | Laskowski | 431/359 X |
| 3,694,697 | 9/1972 | Kim | 431/359 X |
| 3,884,615 | 5/1975 | Sobieski | 431/362 |
| 3,904,348 | 9/1975 | Bouchard et al. | 431/362 |

FOREIGN PATENT DOCUMENTS

| | | | |
|---|---|---|---|
| 588183 | 12/1959 | Canada | 431/362 |
| 945805 | 7/1956 | Fed. Rep. of Germany | 431/362 |
| 1189852 | 3/1965 | Fed. Rep. of Germany | 431/358 |
| 867635 | 5/1961 | United Kingdom . | |
| 872638 | 7/1961 | United Kingdom . | |
| 961804 | 6/1964 | United Kingdom . | |
| 1162697 | 8/1969 | United Kingdom | 431/359 |

*Primary Examiner*—Robert S. Ward, Jr.
*Attorney, Agent, or Firm*—Robert S. Smith

[57] ABSTRACT

A flashbulb in which a filament and paste are not required. The flashbulb is not only cheaper but is faster in operation. This is primarily achieved by ensuring that the mass of finely-shredded combustible metal strips provided in such flashbulbs are in contact with the lead-in current conductors in the bulb. Due to the oxidizing atmosphere, the strips have an electrically-insulating skin. It has been found that this skin can readily be broken down by the momentary application of a voltage, whereupon the strips form a current-conducting path between the electrodes and ignition can then be affected with a voltage lower than the breakdown voltage.

10 Claims, 11 Drawing Figures

2/2

COMBUSTION FLASHBULB

The invention relates to a combustion flashbulb having a sealed vacuum-tight tubular, light transmissive envelope which is filled with an oxidizing gas and contains a mass of finely-shredded actinically combustible metal strip, in which spaced current conductors extend from the exterior through and into the envelope wherein each is in contact with the mass of metal strips, said bulb having electrical ignition means to ignite the flashbulb in response to the application of a voltage thereto.

Such a flashbulb is disclosed in U.K. Pat. No. 961,804.

The important advantage of the known lamp as compared with other known lamps is that the lamp comprises no ignition paste. As a result of this the manufacture of the lamp is safer, the possibility of spontaneous ignition being considerably smaller, and the luminous flux is larger because less blackening of the lamp envelope occurs.

The ignition means of said known flashbulb consist of a filament wire of the metal of which the mass also consists, which wire is connected between the current conductors. The flashbulb is ignited by applying a voltage of 3 Volts across the current conductors.

As photocameras become lighter and lighter in weight, so the possibility of lack of sharpness of the recorded image due to motion of the camera when using conventional flashbulbs and with shutter times of 25 ms or more increases. It is therefore desirable to have faster operating flashbulbs available, producing a flash of shorter duration.

Figure 2:
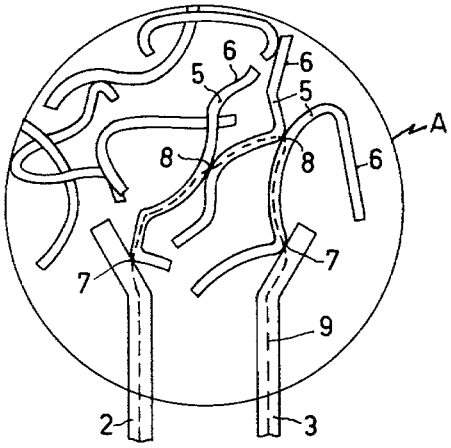

As shown in FIG. 2 of the British patent referred to above the flashbulb without ignition paste described therein, as well as conventional lamps with which said lamp is compared, has reached its highest luminous flux only after approximately 20 ms. after the instant of application of the ignition voltage. Fifteen milliseconds after this, the luminous flux has only decreased to 50% of the highest value.

It is the object of the invention to provide considerably faster operating combustion flash bulbs, producing a flash of shorter duration, which in addition are of a simpler construction.

In agreement herewith the invention relates to a combustion flashbulb of the kind mentioned in the preamble which is characterized in that the ignition means safely consist of the current conductors and part of the mass of metal strips. More specifically the part that is in contact with the current conductors.

The flashbulb according to the invention can be manufactured more easily than the known flashbulb. Not only does it not have an ignition paste, it also has no filament. The result of this is that the current conductors need not be united by means of a glass bead to form a rigid assembly and also that the cumbersome step of mounting a thin combustible filament to the comparatively thick current conductors is avoided.

The flashbulb according to the invention is surprisingly rapid in operation. In the initial experiments, flashbulbs were obtained in which the highest luminous flux was obtained well within 10 ms of the instant of application of the ignition voltage, while they radiated 85% of the totally generated quantity of light within 15 ms from that instant.

Actinically combustible metals such as zirconium which are used in combustion flashbulbs for the manufacture of the mass of metal strips naturally form an oxide skin due to the surrounding oxidizing gas. The result of this skin is that a resistance of more than $10^8$ ohm is measured prior to ignition between the current conductors of a flash bulb according to the invention. This resistance value is comparable with that of flashbulbs having an ignition paste which are ignited with a high voltage, generated for example by a piezo-crystal.

It has surprisingly been found that in lamps according to the invention a short-lasting low energy voltage pulse, for example 25 to 50 V or even less, for 10 to 20 microseconds, is sufficient to obtain breakdown of the oxide skin at the points of contact between metal strips and between metal strips and the current conductors but insufficient to cause ignition. As a result of this breakdown, the resistance between the current conductors decreases to a low value, for example of 20 to 50 Ohm. On this breakdown, metal strips of the mass effectively form a filament between the current conductors of the flash bulb. Said filament is mechanically weak, for which reason the flashbulb is preferably ignited by applying a filament current immediately after breakdown. A voltage of 10 to 15 V has proved to be sufficient for this purpose.

In the known flashbulb the ignition means form a low-ohmic resistance, whereas in the lamp according to the invention they initially form an impedance having a capacitive character. The capacitors formed by the metal strips with their oxide skin and the current conductors can be broken down by an energy dissipation of approximately 30 to 40 microjoules. Said energy can be derived for example, from a piezocrystal. This is very low compared with the 2 mJ necessary for igniting the contents of the bulb by heat evolution in the "filament" formed as a result of the breakdown.

The low energy dissipation upon breakdown and the larger energy required for ignition, together with the mechanical weakness of the filament formed during the breakdown, constitute a guarantee against spontaneous ignition. If as a matter of fact an electric charge is generated, for example by friction, which may cause breakdown, said breakdown takes place and dissipates the energy before the energy contents of the charge can result in combustion. In addition, the falsely-formed filament may be rapidly destroyed by weak mechanical shocks. In the case the current conductors extend into the envelope parallel to each other they may be bent outwards in the envelope in order to promote the contact of the mass of metal strips with the current conductors on inversion of the mass into the bulb via the open upper end of the envelope during manufacture. It is to be preferred for the current conductors to extend into the envelope over a reasonable distance, for example over a distance up to $\frac{1}{3}$ of the length of the envelope. This increases the speed at which the combustion front propagates through the whole envelope.

Alternatively, the current conductors may enter the envelope in oppositely located places, for example, in such manner that upon breakdown a conductive track is formed in the longitudinal direction of the bulb and which may have the length of the bulb. In a special embodiment, more than two current conductors are used. This presents the possibility of producing breakdown between various pairs of current conductors and, upon applying a filament voltage, causing a more stretched "filament" to glow and obtaining a faster ignition of the bulb. For example, when three current conductors are used, one of which enters the bulb at a first end and two of which enter the bulb at the second end, a breakdown can be formed which traverses twice the length of the bulb.

The metal strips which are used in the flashbulbs according to the invention may be cut from foil having a thickness of from 10 to 30 micrometers. The strip width may be chosen between the same limits. Generally strips are used having a rectangular cross-section of 15×15 micrometers to 20×30 micrometers. The length of the strips may vary from a few millimeters to some ten centimeters.

The ignition of a lamp according to the invention may be effected in two separate steps, in which first a very low energy (30–40 microjoules) voltage is applied to produce break down and then a higher energy voltage (about 2 mJ) voltage is applied to provide a filament current. In this case it is preferable to apply the second voltage the instant after the break down. An alternative, however, is the connection of a voltage source at sufficient voltage and energy (2–3 mJ) to produce both a break down and a filament current. Another alternative arises from the fact that the minimum voltage required for breaking down the oxide skin is higher than the minimum voltage required to generate a filament current after break down. Thus the voltage source which supplies the filament current may be applied to the flash bulb some time before the ignition thereof. For igniting the flashbulb it is only necessary to apply the higher break down voltage, and this for a very short period of time.

It is to be noted that U.S. Pat. No. 2,868,003 discloses a flashbulb of which one of the two electrodes is covered with an igniting paste. The bulb is filled with an oxidizing gas and a tangle of combustible metal strips.

This lamp is ignited by means of a voltage pulse of a few hundred Volts. Upon igniting, a series of arc-discharges occur which complete the current path in the lamp. The current travels from the electrode through the igniting paste to the metal strips and thence to the other electrode. If the electrode provided with igniting paste is not covered entirely by the paste, the remaining part of the electrode is covered by an insulator so as to prevent short circuit between the electrodes.

The invention also relates to an electric device for igniting a combustion flash bulb according to the invention, characterized by a combination of connection terminals for connection to the flashbulb, first means to generate a first voltage, second means to generate a second, lower, voltage for igniting the flashbulb in the terminals, switching means which can be operated by the shutter of a camera to apply the first voltage to the terminals for a given period on operation of the switching means and to apply after the period the second voltage to the terminals.

In one embodiment the device comprises a voltage source as second means and the first means comprise a voltage amplifier which is fed by the voltage source.

In a variation of this embodiment the switching means renders the voltage amplifier operative for the said period of time, and the voltage source is connected, via a diode, to the connection terminals for the flashbulb.

Another embodiment of the device comprises a combination of a first current circuit comprising a capacitor which, via a current-limiting element, is connected to a first and a second input terminal for a voltage source, which capacitor is shunted by a second circuit in which the primary winding of a transformer and a switch are incorporated, and a third circuit in which the secondary winding of the transformer is connected at one end via a first diode to a first connection terminal and, at the other end, to a second connection terminal for the flash bulb and to the second input terminal for the voltage source, the first connection terminal for the flashbulb being connected also via a diode, which is in the same direction as the first diode, to the first terminal for the voltage source.

Such a device is preferably incorporated in a photocamera the shutter of which is coupled to the switch of the device. However, the device may alternatively be incorporated in a flash apparatus or in a flashbulb unit, or form a separate part of a photographic equipment.

A flash bulb according to the invention may be used in a flash apparatus which is provided with a fresh lamp after each flashing or in a flash bulb unit comprising a plurality of such flashbulbs arranged in a sequentially operable manner. These units are to be understood to include both units in which an unignited lamp is moved into the flashing position by mechanical means, and units in which this is done electrically.

The invention also relates to such a flash bulb unit.

In a unit in which the bulbs are electrically sequenced, the flashbulbs may be connectable in parallel. It is possible to select the sequence in which the flashbulbs will be flashed by switching each subsequent lamp in the ignition circuit by means of a switch which is closed under the influence of the radiation of the preceding flashbulb in the sequence. It is alternatively possible, however, that the sequence of the flashing of the flashbulbs is made to depend on the break down voltages of the bulbs in a unit. In a flash bulb unit having several parallel-connected flashbulbs, always one flashbulb, namely that with the lowest break down voltage, will be flashed upon applying a sufficiently high voltage, after which the voltage across the flashbulb, and hence the voltage across all the other bulbs in the unit, decreases as a result of current passage in the flashbulb being flashed. When the unit is energized for the second time, that one bulb will be ignited which then has the lowest break down voltage.

In units having several parallely arranged flashbulbs it is necessary that no voltage can flow away through a flashbulb upon igniting a subsequent flashbulb. Flashbulbs according to the invention generally have a high resistance after flashing. If, however, the ratio of the combustible metal in the lamp to the oxidizing gas prior to flashing was much smaller than the stoichiometric ratio, so much metal may be left in the lamp after flashing that a conductive connection exists between the current conductors. Such a connection may also be formed by moisture which has penetrated after flashing. In that case break switches may be incorporated in the unit which are each connected in series with a respective flash bulb and are interrupted upon flashing.

An alternative possibility is to prevent, by structural measures, that a conductive coating of combustion products and/or metal residues which connects the current conductors can be formed on the wall of the envelope in the region where the current conductors are led through. This possibility is eliminated, for example, if at least one current conductor is embedded in electrically insulating material over a part of its length up to the wall of the envelope. Thus current conductor may be partly enveloped with a glass tube or the current conductors may be sealed in and moved inwardly while the glass of the envelope is still soft.

Figure 1:
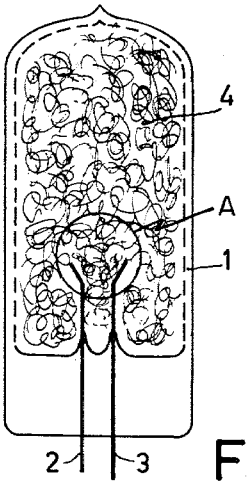
Figure 3:
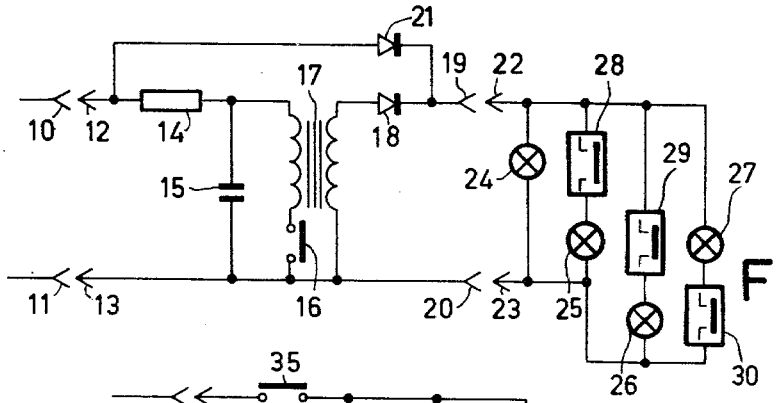
Figure 4:
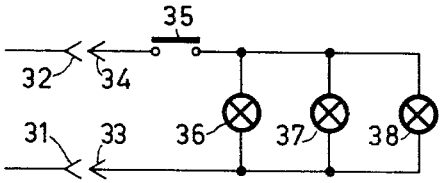
Figure 7:
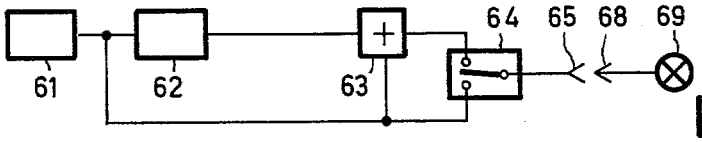
Figure 8:
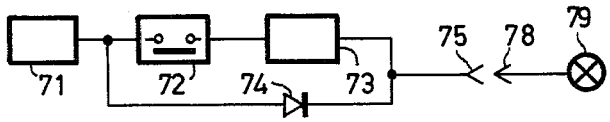
Figure 9:
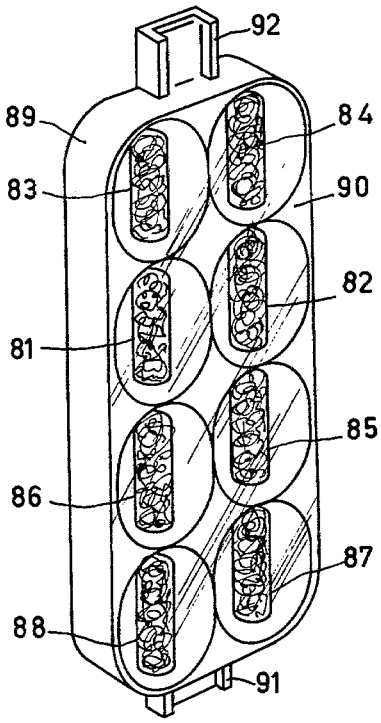
Figure 10:
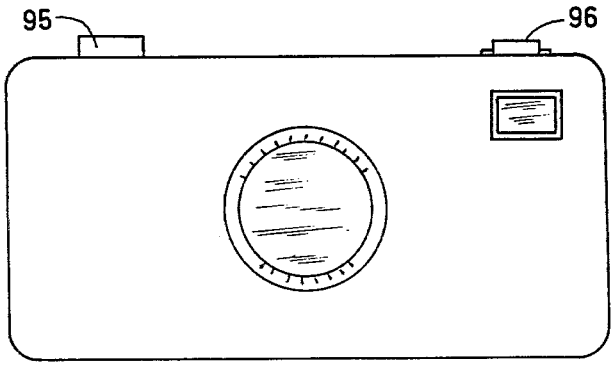

Embodiments of the invention will now be described, by way of example, with reference to the accompanying drawings, of which:

FIG. 1 is a front elevation of a flash bulb in accordance with the invention, FIG. 2 shows an enlarged detail A of the bulb shown in FIG. 1, FIG. 3 shows the electric circuit diagram of an electric ignition device and a flash bulb unit, FIG. 4 shows the electric circuit diagram of another flash bulb unit, FIGS. 5 to 8 each show a block schematic diagram of an electric ignition device, FIG. 9 shows a perspective view of a flash bulb unit, and FIG. 10 is an elevation of a photographic camera.

Figure 11:
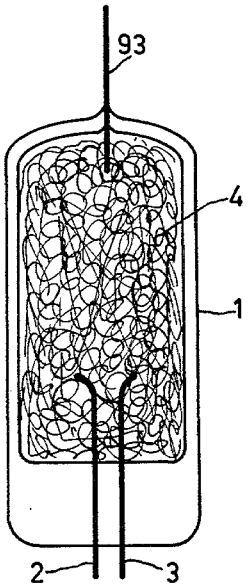

FIG. 11 is the front elevation of a modified embodiment of the bulb shown in FIG. 1.

In FIG. 1, current conductors 2 and 3 extend through a glass envelope 1 and contact a mass 4 of finely-shredded actinically combustible metal strips. The envelope is filled with an oxidizing gas, for example, oxygen.

After the current conductors 2 and 3 were sealed in the envelope 1, they were moved inwardly while the glass of the envelope was still soft in order to envelope them partly with glass inside the bulb.

FIG. 2 shows the circled portion A of FIG. 1 on an enlarged scale. The current conductors 2 and 3 terminate in a mass of metal strips 5, each having an oxide skin 6. Due to the oxide skins, capacitances exist at the points of contact 7 of the metal strips 5 and the current conductors 2 and 3 and at the points of contact 8 of the metal strips 5 with each other, the metal oxide 6 of the strips 5 forming the dielectric. When the capacitances 7 and 8 break down due to an applied voltage, the low-ohmic current path 9 shown in broken lines is formed.

In FIG. 3, reference numerals 10 and 11 denote the connection points of a voltage source (not shown), 12 and 13 are the input terminals of an electric ignition device, 19 and 20 are the connection terminals of said device to connect a flash bulb unit and 22 and 23 denote the contacts of a flash bulb unit.

The electric ignition device comprises a first current circuit in which are incorporated the first and second input terminals 12 and 13, respectively, a resistor 14 and a capacitor 15. The capacitor 15 is shunted by a second circuit in which the primary winding of a transformer 17 and a make switch 16 are incorporated. The secondary winding of the transformer 17 is connected at one end via a first diode 18 to the first connection terminal 19 and at the other end to the second connection terminal 20 and to the second input terminal 13. The first input terminal 12 is connected to the first connection terminal 19 via a second diode 21. The flash bulb unit comprises parallel arranged flash bulbs 24, 25, 26 and 27 and make switches 28, 29 and 30.

The operation of the device is as follows. Capacitor 15 is charged via the resistor 14 by the voltage source having the connection points 10 and 11. When switch 16 is operated, the capacitor discharges across the primary winding of the transformer 17. A higher voltage is generated in the secondary winding of the transformer which results in a voltage across bulb 24 via the circuit 18, 19, 22, 24, 23, 20. This voltage breaks down the oxide skins. Diode 21 prevents current from flowing to the terminal 12. As soon as the voltage across the secondary winding of the transformer 17 decreases below the voltage applied to the terminals 12 and 13, diode 21 becomes conductive. A current starts flowing in the circuit 12, 21, 19, 22, 24, 23, 20, 13 which ignites the bulb 24. Diode 18 prevents the leaking away of the voltage to the secondary winding of the transformer 17. The radiation emitted by the lamp 24 closes the switch 28 so that when switch 16 is operated again, the process is repeated with the lamp 25 instead of lamp 24 in the current circuit, since lamp 24 after ignition assumes a very high resistance.

In FIG. 4, 31 and 32 denote the connection terminals of a voltage pulse source and 33 and 34 denote the input terminals of a flash bulb unit. A voltage pulse can be applied to the bulbs 36, 37 and 38 via a make switch 35. When the switch 35 is operated, the pulse causes break down and ignition to occur in that one bulb which has the lowest break down voltage, for example, lamp 36. When the switch is operated for the second time, a further voltage pulse ignites the lamp which then has the lowest break down voltage, for example lamp 38.

Figure 5:
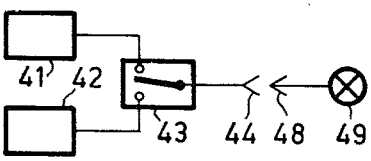

In FIG. 5, 41 denotes further means to generate a break down voltage across a flash bulb 49. 42 denotes second means to generate a voltage which results in a filament current through the lamp 49 after break down. Switching means which can be operated by a shutter are denoted by 43. 44 and 48 denote connection terminals of the ignition device and the lamp.

Figure 6:
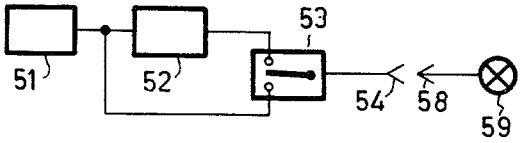

In FIG. 6, 51 is a voltage source the voltage of which is raised by a voltage amplifier 52 to above the minimum break down voltage of a lamp 59. Switching means, corresponding to 43 of FIG. 5, are denoted by 53 and connection means corresponding to 44 and 48 at FIG. 5 are denoted by 54 and 58.

FIG. 7 comprises an adder 63 which adds the voltage of a voltage source 61 to the voltage of voltage source 61 amplified by voltage amplifier 62. Switching means at 64 to supply voltage to lamp 69 via terminals 65 and 68 can be operated by the shutter of a camera.

Voltage source 71 in FIG. 8 is connected to lamp 79 via diode 74 and the terminals 75 and 78. The switching means 72 which can be operated by the shutter of a camera enable the switching on of the voltage amplifier 73. The circuits shown in FIGS. 6, 7 and 8 all provide the initially-high break down voltage followed, on operation of the respective switching means, by a lower voltage which provides filament current for igniting the bulb.

The flash bulb unit shown in FIG. 9 has eight flash bulbs, 81 to 88. The bulbs 81 to 84 belong to a first series, the bulbs 85 to 88 belong to a second series. The lamps are incorporated in a housing 89 which has a transparent cover 90. The unit has two connection members 91 and 92 with which the unit can be coupled to a camera and be electrically connected thereto. When the unit is coupled via member 91, bulbs 81 to 84 can be flashed; when the unit is coupled via member 92, the bulbs 85 to 88 can be ignited.

The photographic camera shown in FIG. 10 has a coupling member 95 capable of cooperating with the connection members 91 and 92 of the flash bulb unit shown in FIG. 9. The electric ignition device shown in FIG. 3 and a voltage source are incorporated in the camera. When operating the button 96 the switch 16 of FIG. 3 is closed and the shutter of the camera is opened.

93 in FIG. 11 denotes a third current conductor. Break down in the lamp can be produced between the conductors 2 and 93 and between the conductors 3 and 93. The ignition voltage may then be applied across the conductors 2 and 3.

EXAMPLE 1

Two current conductors of nickel-plated copper-clad wire of 0.4 mm diameter are sealed at a mutual distance of 1.6 mm in the wall of a glass tube having one open end and an inside diameter of 7.4 mm. The tube was provided with a mass of finely-shredded zirconium having a weight of 20 mg. The zirconium strips of the mass had the dimensions 0.02×0.02×104 mm. The open end of the tube was drawn to form a capillary after which the tube was filled with oxygen and the capillary was sealed. The resulting flashbulb had a volume of 0.63 ml. The oxygen pressure was 7 bar at room temperature. The mol-ratio of oxygen and zirconium therefore was 0.85. The current conductors extended into the bulb to over $\frac{1}{3}$ of the length thereof. The bulbs were ignited by a piezo pulse instantaneously followed by a current having a voltage of 15 V.

For comparison, flashbulbs were manufactured in which the current conductors in the lamp were connected by a 1.5 mm long filament ignition wire of tungsten with 3% by weight of rhenium (diameter 17 μm) and at the connection points to the conductors a primer was provided of the composition 69% by weight of Zr, 27.6% by weight of $KClO_4$ and 3.4% by weight of nitrocellulose. Otherwise said bulbs were identical to the above-described lamps. These bulbs were ignited by 3 V 3A flash circuit.

The principal data of these two flashbulb types are recorded in the following table:

| Flashbulb | Q(0–15 ms) lumensec | $\phi_{max}$ lumen × $10^3$ | $t_{max}$ msec | $T_{keff}$ °K. |
|---|---|---|---|---|
| A | 2960 | 340 | 8.5 | 4390 |
| B | 2230 | 315 | 11.0 | 4330 |

A = flashbulb according to the invention
B = comparison flashbulb with filament and primer
Q (0–15 ms) = luminous efficiency to 15 ms after energizing of the lamp
$\phi_{max}$ = maximum luminous flux
$t_{max}$ = instant at which $\phi_{max}$ was reached
$T_{keff}$ = effective color temperature in the period 0–40 ms From these data it can be seen that the flashbulb according to the invention is not only faster but also radiates over 30% more light of a higher color temperature, within 15 ms.

EXAMPLE 2

Bulbs (A') differing from the lamps (A) of example 1 by the use of zirconium strips of 0.015×0.015×104 mm, but otherwise were identical, were compared with bulbs (B') which differed in the same component from the reference bulbs of example 1.

A number of the bulbs in accordance with the invention (hereinafter referenced $A'_2$) were ignited in the same manner as in example 1, i.e. by a piezo pulse succeeded by a current with a voltage of 15 V. A second group of bulbs ($A'_1$) were ignited by connecting a current source of 70 V.

As in example 1, the reference bulbs were ignited by a 3 V 3 A flash circuit.

The following table states the characteristic data of the bulbs.

| Bulbs | Q (0–15 m sec) lumen sec. | $\phi_{max}$ lumen × $10^3$ | $t_{max}$ m sec | $T_{keff}$ °K. |
|---|---|---|---|---|
| $A_2'$ | 3.000 | 360 | 7.5 | 4.380 |
| $A_1'$ | 3.600 | 430 | 5.0 | 4.480 |
| B' | 2.300 | 285 | 9.0 | 4.290 |

From these data the same conclusion may be drawn as from those of example 1. Moreover, the use of one current source which produces both breakdown and the incandescence of the formed filament proves to present the advantages of higher luminous efficiency, larger maximum light flux, higher velocity and higher color temperature.

EXAMPLE 3

A flashbulb having three current conductors as shown in FIG. 11 was provided with 20 mg zirconium strips 0.020×0.020×104 mm and 7 bar oxygen. The bulb had a capacity of 0.64 ml.

The bulb was ignited by producing breakdown by means of a piezo pulse between the current conductors 2 and 93 and between 3 and 93. Immediately after breakdown a current source having a voltage of 15 V was connected to the current conductors 2 and 3 on the one hand and 93 on the other hand.

The bulb reached its maximum light flux of 380×$10^3$ lumen 5.5 msec after the connection of the current source.

It is to be noted that the ratio $O_2$/Zr in these experimental lamps was chosen to be lower than is usual in commercial lamps. When the quantity of oxygen is increased to approximately the stoichiometric quantity, the luminous flux further increases.

What is claimed is:

1. A combustion flashbulb having a sealed vacuum-tight tubular light transmissive envelope which is filled with an oxidizing gas and contains a mass of finely shredded actinically combustible metal strips, in which spaced current conductors extend from the exterior through and into the envelope wherein each is in contact with the mass of metal strips, said flashbulb having means to ignite the flashbulb in response to the application of a voltage thereto, characterized in that the ignition means solely consisting of the current conductors and part of said mass, said part being in contact with the current conductors.

2. A combustion flash bulb as claimed in claim 1, characterized in that means are provided to prevent short circuit between the current conductors in the flashbulb after flashing, said means comprising electrically insulating material extending from the envelope over part of the length of at least one of the current conductors.

3. An electric device for igniting a combustion flashbulb as claimed in claim 1 or 2, characterized by a combination of connection terminals for connection to the flashbulb, first means to generate a first voltage, second means to generate a second, lower, voltage for igniting the flashbulb via the terminals, and switching means which can be operated by the shutter of a camera to apply the first voltage to the terminals for a given period on operation of the switching means and to apply after said period the second voltage to the terminals.

4. An electric device as claimed in claim 3, characterized in that the second means is a voltage source and the first means comprise a voltage amplifier which is fed by the voltage source.

5. An electric device as claimed in claim 4, characterized in that the switching means renders the voltage amplifier operative for said period and in that the voltage source is connected via a diode to the connection terminals.

6. A flashbulb unit comprising a plurality of combustion flashbulbs as claimed in claim 1 or 2.

7. A flashbulb unit as claimed in claim 6, characterized in that an ignited flashbulb automatically prepares one of the remaining flashbulbs for subsequent ignition.

8. A flashbulb unit as claimed in claim 6, characterized in that the unit further comprises an electric device for igniting a combustion flashbulb having a sealed vacuum-tight tubular light transmissive envelope which is filled with an oxidizing gas and contains a mass of finely shredded actinically combustible metal strips, in which spaced current conductors extend from the exterior through and into the envelope wherein each is in contact with the mass of metal strips, said flashbulb having means to ignite the flashbulb in response to the application of a voltage thereto, the ignition means solely consisting of the current conductors and part of said mass, said part being in contact with the current conductors, said device being characterized by a combination of connection terminals for connection to the flashbulb, first means to generate a first voltage, second means to generate a second, lower, voltage for igniting the flashbulb via the terminals, switching means which can be operated by the shutter of a camera to apply the first voltage to the terminals for a given period on operation of the switching means and to apply after said period the second voltage to the terminals.

9. A photocamera comprising an electric device as claimed in claim 3.

10. A flashbulb unit as claimed in claim 7, characterized in that the unit further comprises an electric device for igniting a combustion flashbulb having a sealed vacuum-tight tubular light transmissive envelope which is filled with an oxidizing gas and contains a mass of finely shredded actinically combustible metal strips, in which spaced current conductors extend from the exterior through and into the envelope wherein each is in contact with the mass of metal strips, said flashbulb having means to ignite the flashbulb in response to the application of a voltage thereto, the ignition means solely consisting of the current conductors and part of said mass, said part being in contact with the current conductors, said device being characterized by a combination of connection terminals for connection to the flashbulb, first means to generate a first voltage, second means to generate a second, lower, voltage for igniting the flashbulb via the terminals, switching means which can be operated by the shutter of a camera to apply the first voltage to the terminals for a given period on operation of the switching means and to apply after said period the second voltage to the terminals.

* * * * *